United States Patent [19]

Christian

[11] 4,015,297

[45] Apr. 5, 1977

[54] SAFETY CANOPY FOR CRIB

[76] Inventor: Dorothy A. Christian, P.O. Box 1493, Sedona, Ariz. 86336

[22] Filed: Nov. 26, 1975

[21] Appl. No.: 635,717

[52] U.S. Cl. ..... 5/97; 5/93 R; 150/52 R

[51] Int. Cl.[2] ..... A47C 29/00; B65B 11/00

[58] Field of Search ..... 5/97, 334 C; 297/441, 297/184; 150/52 R; 135/5.1

[56] References Cited

UNITED STATES PATENTS

| | | | |
|---|---|---|---|
| 122,737 | 1/1872 | Riter | 5/97 |
| 855,551 | 6/1907 | Avara | 5/97 |
| 1,134,009 | 3/1915 | Reid | 135/5.1 |
| 2,912,044 | 11/1959 | Giffen | 297/184 |
| 2,927,331 | 8/1960 | Ruiz | 5/97 |
| 2,954,635 | 10/1960 | Stotter | 150/52 R |
| 3,013,283 | 12/1961 | Steffinich | 5/334 C |
| 3,145,396 | 8/1964 | Zindell | 5/97 |

*Primary Examiner*—Paul R. Gilliam
*Assistant Examiner*—Victor N. Sakran
*Attorney, Agent, or Firm*—Drummond, Nelson & Ptak

[57] ABSTRACT

A generally horizontal, rectangular panel has end and side panels depending therefrom which are adjoined along respective vertical edges to form a shallow box-like structure which closely receives the top of a crib or similar enclosure. Attachment means are provided at each corner of the box-like structure for detachable securement to the enclosure. Preferably the box-like structure is fabricated of flexible foraminous material.

2 Claims, 5 Drawing Figures

SAFETY CANOPY FOR CRIB

This invention relates to cribs, playpens and other similar enclosures for children.

More particularly, the present invention relates to a safety device for retaining a child within an enclosure.

In a further aspect, the instant invention concerns a safety canopy which is received over the top of a crib, playpen or similar enclosure and detachably secured thereto.

Young children generally spend considerable time in cribs, playpens and similar enclosures. During early growth and development prior to walking or other dextrous coordination a child learns to pull himself up by almost any available support means. Children of this age also have a natural tendency to try to climb. When a child pursues such activities from within a crib or other enclosure his efforts are frequently rewarded by a painful or injurious fall.

For the most part, the time a child spends in cribs, playpens and similar enclosures is not attended by immediate adult supervision. In fact, one of the attractive benefits to be derived from the use of such devices is that the mother or child attendant is relatively free to pursue other chores. Presumably the child is relatively safe and needs only occasional inspection. However, the knowledge that the child could fall from the enclosure is a source of constant anxiety.

In recognition of the foregoing hazard, the prior art has provided various devices which have the intended purpose of retaining a child within a crib or playpen. Commonly these devices provide a covering which is placed over the opening of the enclosure. In accordance with one structure the cover is secured to the top rails of the enclosure by a plurality of straps and buckles. Another scheme utilizes a netting which folds over the top of the enclosure and has a plurality of elongate straps depending therefrom having a snap hook at the lower end which engages a ring encircling the lower rail of the crib. Yet other devices completely enclose the enclosure and include a zippered opening for access to the child.

While generally accomplishing the intended purpose of retaining the child within the enclosure, the prior art devices display various inherent limitations. For example, the numerous fastening devices render the covers extremely cumbersome to attach. The numerous fastening means also hinder attempts to reach the child quickly in the case of an emergency. The manner of securing the fastening means to the enclosure render certain components thereof inoperative such as the drop side of a crib.

It would be highly advantageous, therefore, to provide improved safety means for retaining a child within a crib, playpen or similar enclosure.

Accordingly, an object of the present invention is the provision of a safety canopy for use in combination with cribs, playpens and other enclosures for children.

Another object of the invention is to provide a means for retaining a child within an enclosure and preventing the child from climbing and falling over the edge thereof.

Still another object of the invention is the provision of a safety canopy which is readily and conveniently attachable to an enclosure.

Yet another object of the instant invention is to provide a safety canopy which will not interfere with the normal mechanical functions of the enclosure such as the drop side of a crib.

A further object of the invention is to provide a safety canopy which is readily releasable for obtaining access to the child in the event of an emergency.

And a further object of the invention is the provision of a device of the above type which is durably constructed yet relatively inexpensive to manufacture.

Briefly, to achieve the desired objectives of the present invention in accordance with a preferred embodiment thereof, provided is a shallow box-like structure of flexible material. The structure includes a substantially horizontal panel having end and side panels depending therefrom. Respective ends of the side and end panels are adjoined to form a vertical corner. The upper portion of a crib or similar rectangular enclosure is closely received within the box-like structure. Attachment means are provided proximate each corner of the box-like structure for detachable securement to the enclosure.

In accordance further embodiment the lower edge and the corners of the inverted box-like structure are provided with reinforcing lamina. The attachment means includes a strap member secured at one end thereof to the box-like structure and having a loop at the free end thereof. The loop is engageable with a hook embedded into the enclosure.

The foregoing and further and more specific objects and advantages of the present invention will become readily apparent to those skilled in the art from the following detailed description thereof taken in conjunction with the drawings in which.

Figure 1:
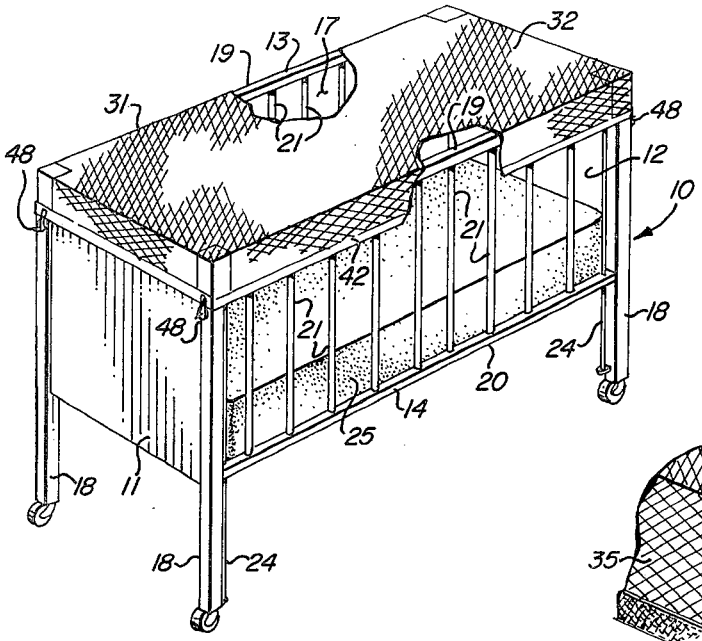
FIG. 1 is an upper perspective view of a safety canopy constructed in accordance with the teachings of the present invention as it would appear when attached to an enclosure for a child herein specifically illustrated as a crib.

Turning now to the drawings in which the same reference numerals indicate corresponding elements throughout the several views, attention is first directed to FIG. 1 which shows an infant's crib generally designated by the reference character 10. In accordance with conventional practice crib 10 includes a pair of spaced vertical end boards 11 and 12 and sides 13 and 14 which form a generally rectangular enclosure 17. Vertical corner posts 18 also function as legs for supporting enclosure 17 above the ground. Whereas end boards 11 and 12 are generally solid, sides 13 and 14 include horizontal top and bottom rails 19 and 20, respectively, in a plurality of spaced vertical rungs 21 extending therebetween.

Typically, one side of a crib is solid while the other side can be manually lowered for one more convenient access to the child. In accordance with the instant illustration side 13 is solidly affixed to end boards 11 and 12. Top and bottom rails 19 and 20 of side 14 are slidably disposed on vertical guide rods 24 which are secured to corner posts 18. Although not specifically herein illustrated, a locking mechanism is provided to retain side 14 in the raised position. Mattress 25 is contained within enclosure 17 and is supported by a sub-frame (not shown). The foregoing detailed description of crib 10 is typical of conventional crib construction and is generally representative of enclosures for the express purpose of retaining infants and children. The foregoing detailed description thereof is presented herein as background for the instant invention.

Figure 2:
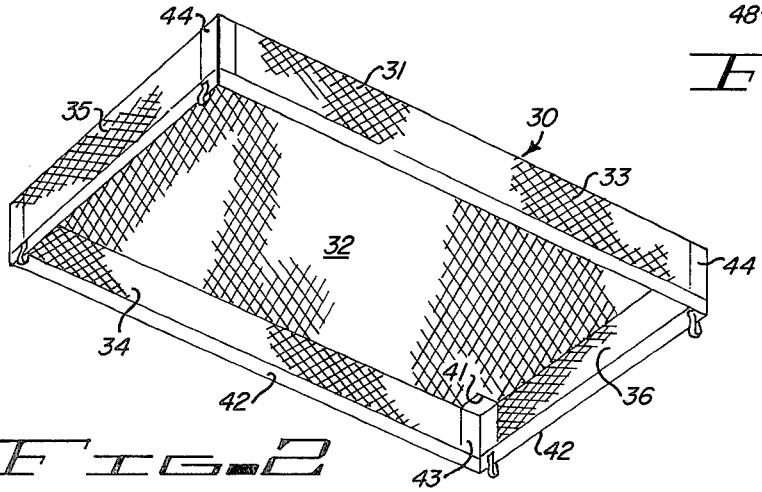
FIG. 2 is a lower perspective view of the safety canopy of the present invention.

The safety canopy of the instant invention generally designated by the reference character 30 and also seen in FIG. 2 has a shallow inverted box-like structure 31 formed by top panel 32, side panels 33 and 34 and end panels 36 and 36.

Top panel 32 is sized and shaped to overlay enclosure 17 and rest upon the upper horizontal edges of end boards 11 and 12, top rails 19 and the upper ends of corner posts 18. Side panels 33 and 34 and end panels 35 and 36 are relatively narrow in the vertical direction. Box-like structure 31 has permanent corners. That is, the ends of end panel 35 are secured to respective ends of side panels 33 and 34 and respective ends of end panel 36 are secured to respective ends of side panels 33 and 34.

Figure 3:
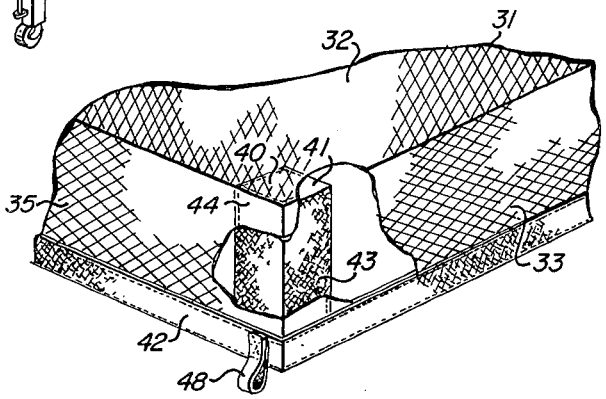
FIG. 3 is an enlarged partial perspective view of the safety canopy of the present invention particularly illustrating a typical corner thereof.

Preferably structure 31 is fabricated of a fireproof mesh such as is commonly produced from Fiberglas or various plastics. For durability and other reasons box-like structure 31 is reinforced at the corners and along the lower edge as viewed in FIG. 3. In accordance with a preferred embodiment of the invention all reinforcement is in the form of a heavy cloth lamina sewn to either side of each area designated to be reinforced. Two square reinforcing members 40 and 41 are sewn or otherwise secured to the top surface and bottom surface, respectively, of top panel 32 at each corner thereof. A doubled reinforcement 42 extends continuously about the lower edge of box-like structure 31 receiving a free edge of side panels 33 and 34 and end panels 35 and 36 therebetween. Further reinforcement of the corner is provided by internal L-shaped member 43 extending between reinforcing member 41 and doubled reinforcement 42 and external L-shaped member 44 extending between reinforcing member 40 and doubled reinforcement 42. Accelerated wear and abrasion of structure 31 is induced at the upper edges of corner post 18. Therefore, reinforcing members 40, 41, 43 and 44 should be of sufficient area to overlay corner post 18.

Figure 4:
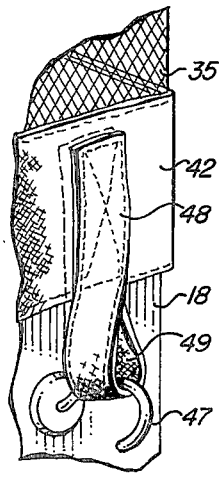
FIG. 4 is an enlarged partial perspective view of the device of the instant invention and especially illustrating the attachment means associated therewith.

Attachment means for detachably securing box-like structure 31 to crib 10 is best illustrated with reference to FIG. 4. Hook 47 is secured to corner post 18 with the open portion of the hook extending downwardly. Preferably hook 47 is of the type having a wood screw integral with the shank. Experience has shown that a conventional "cup hook" is satisfactory for this purpose. Strap member 48 is doubled to form loop 49 and secured at each end thereof to opposite sides of doubled reinforcement 42.

Referring again to FIG. 1, it is seen that when the safety canopy 30 of the instant invention is attached to crib 10 top panel 32 is substantially horizontal and the upper end of enclosure 17 is closely received within box-like structure 31. The securement of strap members 48 to corner posts 18 does not interfere with the mechanical function of drop side 14. Doubled reinforcement member 42 provides sufficient mechanical strength between the attachments at the corners that the child cannot raise the lower edge of box member 31 above top rails 19.

Figure 5:
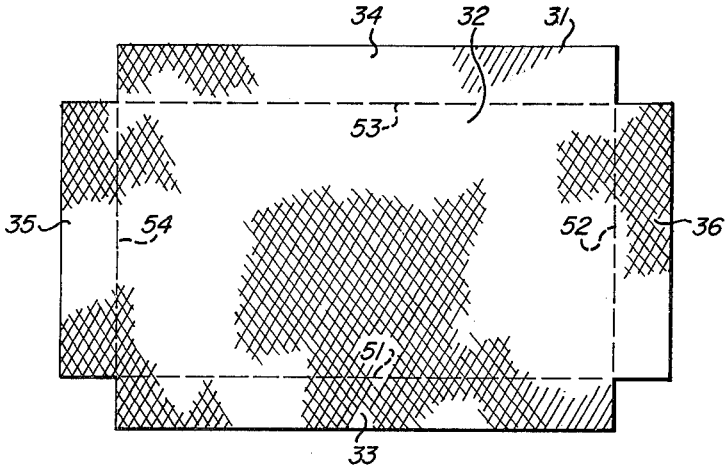
FIG. 5 is a plan view of the canopy of the instant invention as it would appear during an early stage of fabrication.

FIG. 5 illustrates the fabrication of box-like structure 31 from a single sheet of material. After removing a square of material at each corner thereof the sheet is folded along dashed lines 51, 52, 53 and 54. Subsequently, the respective ends of the end and side panels are adjoined and reinforced as hereinbefore decribed.

Side and end panels 33, 34, 35 and 35, respectively, are elongate. Dashed line 51 is simultaneously a side edge of top 32 and a longitudinal edge of side panel 33. Dashed line 53 is the side edge of top panel 32 opposed to side edge 51 and is concurrently a longitudinal edge of side panel 34. Similarly, dashed lines 52 and 54 are end edges of top panel 32 and longitudinal edges of end panels 36 and 35, respectively. It is immediately apparent, therefore, that top panel 32, side panels 33 and 34 and end panels 35 and 36 may alternately be separate pieces of material which are sewn or otherwise adjoined along respective edges. In another alternately preferred embodiment side and end panels 33, 34, 35 and 36 may be an integral unit of an elongate strip of material formed into a loop by adjoining the two edges and subsequently affixed to the perimeter of top panel 32.

Various other changes and modifications to the embodiments herein chosen for purposes of illustration will readily occur to those skilled in the art. For example, strap members 48 may be a single length of strap sewn at one end to box-like structure 31 and having a doubled loop sewn at the free end thereof. The loop may be directly attachable to the eye or encircle a ring for the purpose of engaging the eye. Similarly, strap 48 may be fabricated of elastic material.

As specifically illustrated herein the attachment means of the device of the instant invention are secured to the corner post of the crib. In a more general sense it is intended that the attachment means are affixed to a solid part of the closure so as not to interfere with any mechanical function thereof.

Having fully described and disclosed the present invention and the preferred embodiments thereof in such clear and concise terms as to enable those skilled in the art to understand and practice the same, the invention claimed is:

1. A safety canopy for use in combination with a generally rectangular crib for containing a child and including a pair of spaced upright stationary end panels and a pair of spaced upright side panels extending between said end panels, at least one of said upright side panels being movable, said canopy comprising:

a shallow inverted box-like structure sized and shaped to closely receive and conform to the upper portion of said crib therein and including, i. a substantially horizontal top panel of flexible foraminous material, sized and shaped to overlay said crib and having opposed pairs of end and side edges, reinforcing means for positioning and at each corner of securing said box-like structure on said crib independently of the movable side panel for permitting movement of the movable side panel without interference by said canopy in its secured position including, ii. a pair of elongate side panels of reinforced flexible material, each of said elongate side panels being secured along one of its longitudinal edges to one of said side edges of said horizontal panel and depending therefrom, and iii. a pair of elongate end panels of reinforced flexible material, each of said elongate end panels being secured along one of its longitudinal edges to one of said end edges of said horizontal panel and depending therefrom, each said elongate end panel being secured at its ends to the adjacent ends of said elongate side panels and forming the substantially vertical corners of said box-like structure; and b. attachment means extending downwardly from said elongate end panels proximate each corner of said box-like structure for detachably securing said structure solely to the stationary portion of said crib.

2. The canopy of claim 1, further including a reinforcing lamina, carried at each corner of said box-like structure and including:

a. a first member secured to said horizontal panel;

b. a second member secured to said side panel; and c. a third member secured to said end panel.

* * * * *